United States Patent [19]

Del Pesco et al.

[11] Patent Number: 4,810,411

[45] Date of Patent: Mar. 7, 1989

[54] SOLVENT-BASED FABRIC PROTECTOR

[75] Inventors: Thomas W. Del Pesco, Hockessin; Gerald C. Culling, Newark, both of Del.

[73] Assignee: E. I. Du Pont de Nemours and Company, Wilmington, Del.

[21] Appl. No.: 77,018

[22] Filed: Jul. 23, 1987

Related U.S. Application Data

[63] Continuation of Ser. No. 853,441, Apr. 16, 1986, abandoned.

[51] Int. Cl.[4] ..... C09D 9/00

[52] U.S. Cl. ..... 252/162; 252/172; 252/174.23; 252/174.24; 252/8.6; 252/8.8; 252/8.9

[58] Field of Search ..... 252/8.6, 8.8, 8.9, 162, 252/172, 174.23, 174.24, 90; 106/311

[56] References Cited

U.S. PATENT DOCUMENTS

| | | | |
|---|---|---|---|
| 3,535,156 | 10/1970 | Turner | 117/161 |
| 3,737,386 | 6/1973 | Geiss et al. | 252/162 |
| 3,856,695 | 12/1974 | Geiss et al. | 252/162 |
| 3,915,902 | 10/1975 | Ancel et al. | 252/162 |
| 4,100,225 | 7/1978 | Mueller | 525/324 |
| 4,169,807 | 10/1979 | Zuber | 252/172 |
| 4,268,407 | 5/1981 | Hey et al. | 252/162 |
| 4,288,339 | 9/1981 | Wilsberg | 252/162 |
| 4,517,108 | 5/1985 | Hisamoto et al. | 252/162 |
| 4,578,209 | 3/1986 | Hisamoto et al. | 252/162 |
| 4,606,841 | 8/1986 | Basu et al. | 252/162 |
| 4,606,844 | 8/1986 | Aguilera et al. | 252/162 |

*Primary Examiner*—Josephine Barr
*Attorney, Agent, or Firm*—Charles E. Feeny

[57] ABSTRACT

Textile treatment compositions are disclosed, comprising polymers of perfluoroalkyl (meth)acrylate and other monomers such as 2-chlorohydroxypropyl methacrylate or other alkyl (meth)acrylates; propylene glycol monomethyl ether; and trichlorotrifluoroethane.

16 Claims, No Drawings

SOLVENT-BASED FABRIC PROTECTOR

This application is a continuation of application Ser. No. 853,811 filed Apr. 16, 1986 now abandoned.

BACKGROUND OF THE INVENTION

The present invention relates to fluoropolymer compositions for imparting oil- and water-repellency to textiles by solvent application.

The patent literature discloses numerous fluoropolymer compositions having utility as textile treating agents. These fluoropolymers generally contain pendent perfluoroalkyl groups of three or more carbon atoms, which provide oil- and water-repellency when the compositions are applied to fabric surfaces. Methods for producing such polymers, either in aqueous emulsion or in solvent systems, are well known.

Generally, oil- and water-repellent fluoropolymers are applied to textiles as a latex emulsion in an aqueous bath. However, there are a number of applications wherein application of fluorochemical textile finishes from organic solvent media is desirable. For example, solvent-applied finishes can be used on particular fabrics, e.g., expensive upholstery, where unique or delicate fabric characteristics preclude use of water-based materials. Solvent finishes are also ideally suited for use by commercial dry-cleaners, who employ conventional dry cleaning equipment and solvents for both cleaning and refurbishing of rainwear. In addition, solvent finishes can be applied to textiles from aerosols, which are convenient for the home consumer.

The customary means of preparing a textile finish for solvent application is to dissolve the active ingredient in a suitable organic solvent. In the case of many fluorochemical textile finishes, however, this presents a problem because these compounds generally have inherent insolvency in most non-polar solvents. Moreover, difficulties are encountered in achieving uniform application, or spreading, of the fluoropolymer on the textile surface prior to evaporation of solvent. Too-rapid solvent evaporation results in "frosting", particularly on dark fabrics.

Finally, many organic solvents are toxic or highly flammable, necessitating stringent environmental controls. New non-hazardous, non-flammable solvent-borne fabric treatment agents with superior performance are of significant interest to the apparel, furnishings, and textile industries, as well as to home users of aerosol fabric treatment agents.

SUMMARY OF THE INVENTION

The present invention provides solvent-based fabric treatment compositions for imparting oil- and water-repellency to textiles, comprising by weight:

(a) 0.1–5% fluoropolymer comprising (1) 40–90% polymer chain units derived from a perfluoroalkyl (meth)acrylate monomer of formula $CF_3CF_2(CF_2)_kC_2H_4OC(O)CR=CH_2$, where R is —H or —$CH_3$ and k is an even integer from 2 to 12; and (2) 10–60% polymer chain units derived from 2-chlorohydroxypropyl methacrylate; or (3) 10–60% polymer chain units derived from an alkyl (meth)acrylate having an alkyl chain length of 2–18 carbons; and optionally, (4) up to 1% polymer chain units derived from N-methylol (meth)acrylamide and/or hydroxyethyl (meth)acrylate; and (b) 0.1–10% propylene glycol monomethyl ether; in a solvent base consisting essentially of at least 80% by weight trichlorotrifluoroethane. In a related aspect, the present invention also provides aerosol spray formulations comprising the above-described compositions in admixture with suitable propellants.

DETAILS OF THE INVENTION

In its broadest aspect, the present invention provides textile treatment compositions containing polymers of perfluoroalkyl (meth)acrylate and other monomers such as 2-chlorohydroxypropyl methacrylate and other alkyl (meth)acrylates; propylene glycol monomethyl ether; and trichlorotrifluoroethane. These compositions are suitable for solvent application, by spraying or otherwise, to impart water and oil repellency to fabrics.

The polymers employed in the compositions of the invention are obtained by polymerizing perfluoroalkyl (meth)acrylate and other monomers by conventional solvent polymerization techniques. Any of the conventional neutral solvents such as ethyl acetate, acetone, methyl isobutyl ketone, 1,1,1-trichloroethane, 1,2-dichlorotetrafluoroethane, 1,1,2-trichloro-1,2,2-trifluoroethane, ethanol, isopropanol, and mixtures thereof can be used. The resulting polymer solutions can be diluted, if desired, with additional polymerization solvent. Alternatively, the polymers can be isolated by removal of solvent.

Conventional free-radical catalysts which are soluble in the solvent system can be used. A suitable catalyst can be any of the commonly known agents for initiating the polymerization of an ethylenically unsaturated compound. Such commonly employed initiators include 2,2'-azodiisobutyramidine dihydrochloride, 2,2'-azodiisobutyronitrile, and 2,2'-azobis(2,4-dimethyl-4-methoxyvaleronitrile). Catalyst concentration can be about 0.1 to 12 percent based on the weight of total monomers.

Conventional chain transfer agents, such as dodecyl mercaptan and isooctyl thioglycolate, and crosslinking agents, such as ethylene dimethacrylate, can be used in amounts of 0.1 to 12 percent by weight of the monomers to control the molecular weight of the polymer.

Two classes of fluoropolymers can be employed in the fabric treatment agents of the present inventions. These classes, herein designated "A" and "B", are described below by reference to monomer composition:

Fluoropolymer Class A (1) 40–90% polymer chain units derived from perfluoroalkyl monomers of the formula $CF_3CF_2(CF_2)_kC_2H_4OC(O)CR=CH_2$, where R is —H or —CH3 and k is an even integer from 2 to 12; and (2) 10–60% polymer chain units derived from 2-chlorohydroxypropyl methacrylate.

Fluoropolymer Class B (1) 40–90% polymer chain units derived from perfluoroalkyl monomers of the formula $CF_3CF_2(CF_2)_kC_2H_4OC(0)CR=CH_2$, where R is —H or —$CH_3$ and k is an even integer from 2 to 12; and (2) 10–60% polymer chain units derived from an alkyl (meth)acrylate having an alkyl chain length of 2–18 carbons; and optionally, (3) up to 1% polymer chain units derived from N-methylol (meth)acrylamide and/or hydroxyethyl (meth)acrylate.

In accordance with the present invention, solutions containing either of the foregoing polymers exclusively, or mixtures of the two, can be formulated. Preferably, however, mixtures are employed. The most preferred compositions of the invention comprise (by weight of fluoropolymer) 60–80% fluoropolymer class A, and 20–40% fluoropolymer class B.

Perfluoroalkyl monomers of the formula $CF_3CF_2(CF_2)_kC_2H_4OC(O)CR=CH_2$, where R is —H or —$CH_3$ and k is an even integer from 2 to 12, are conventional and commercially available. They can be prepared by sterification of an appropriate perfluoroalcohol $CF_3CF_2(CF_2)_kC_2H_4OH$ with (meth)acrylic acid, for example, as described in U.S. Pat. No. 3,282,905. Preferably, the perfluoroalkyl group is linear, although compositions containing branched-chain perfluoroalkyl groups are suitable.

Generally, such perfluoroalkyl monomers are supplied as a mixture of monomers of varying perfluoroalkyl chain length, typically from 4–14 carbons. A representative material contains monomers of the foregoing formula having k equal to 2, 4, 6, 8, 10 and 12 in an approximate weight ratio of 2:35:30:18:8:3.

In preparing fluoropolymers of class A, 2-chlorohydroxypropyl methacrylate is employed as the second monomer constituent.

In preparing fluoropolymers of class B, the second monomer constituent is selected from the group consisting of alkyl (meth)acrylates having alkyl chain lengths of 2 to 18 carbons. As used herein, "alkyl" refers to both linear and branched-chain alkyl groups. Examples of such monomers include methyl (meth)acrylate, ethyl (meth)acrylate, propyl (meth)acrylate, butyl (meth)acrylate, isoamyl (meth)acrylate, 2-ethylhexyl (meth)acrylate, octyl (meth)acrylate, isodecyl (meth)acrylate, lauryl (meth)acrylate, cetyl (meth)acrylate, and stearyl (meth)acrylate. Of the foregoing, 2-ethylhexyl methacrylate is preferred.

In addition, one or more specialized monomers can be incorporated into the fluoropolymers of class B in lesser amounts, e.g., 0.1–1 percent by weight, to impart improved cross-linking and substantivity. These monomer include N-methylol (meth)acrylamide and hydroxyethyl (meth)acrylate.

In addition to fluoropolymer, the compositions of the invention include propylene glycol monomethyl ether (PGME), in the range of 0.1–10% by weight. The function of PGME is twofold: it reduces solvent evaporation rate and enhances spreading of the fluoropolymer over the fabric surface to provide a uniform distribution.

Finally, the solvent base of the compositions of the present invention consists essentially of at least 80% by weight trichlorotrifluoroethane. Minor amounts of other miscible solvents, such as methyl isobutyl ketone or 1,1,1-trichloroethane, which may remain as residues from solvent polymerization steps, will not adversely affect composition performance.

The compositions disclosed herein are useful to impart oil, water, and soil repellency to a wide range of substrates. Due to their organic solubility and repellency properties, the copolymers are easy to apply and require little if any curing; thus, they are particularly suitable for treating substrates such as apparel, upholstered furniture, delicate fabrics, and leather, where mild drying conditions are desirable. The compositions of this invention are adapted to be marketed commercially in the form of stable concentrates that can be diluted readily using additional trichlorotrifluoroethane solvent, or formulated into into aerosol sprays using suitable propellants. Suitable propellants include dichlorofluoromethane, carbon dioxide, mixtures of propane and isobutane, dichlorodifluoromethane, 1,1,1-chlorodifluoroethane, and 1,1-difluoroethane. Of the foregoing, dichlorofluoromethane is preferred.

The following Example illustrates the invention. Unless otherwise indicated, all parts and percentages are by weight. The percent by weight of monomer units in polymers is based on the weights of monomers charged.

EXAMPLE 75 parts perfluoroalkyl monomer of the formula $CF_3CF_2(CF_2)_kC_2H_4OC(O)C(CH_3)=CH_2$, having k is equal to 2, 4, 6, 8, 10 and 12 in an approximate weight ratio of 2:35:30:18:8:3, 25 parts 2-chlorohydroxypropyl methacrylate, and 100 parts methyl isobutyl ketone were charged in a closed vessel. While purging with nitrogen, the resulting solution was heated to 70° C. for one hour, and then one part 2,2'-azodiisobutyronitrile initiator in three parts methyl isobutyl ketone was added. The resulting solution was held at 80° C. for 12 hours. Polymer conversion was 98% was determined by measurement of nonvolatile solids. The polymer solution was then diluted with trichlorotrifluoroethane to provide a solution containing 1% nonvolatile solids, and applied to fabric samples at the rate of 25 parts polymer solution to 100 parts fabric.

Water, oil, and spray repellencies of treated fabric samples were determined as follows:

1. Oil Repellency

Treated fabric samples were tested for oil repellency by a modification of AATCC Standard Test Method No. 118, conducted as follows. A series of organic liquids, identified below, were applied dropwise to fabric samples on a flat horizontal surface. Beginning with the lowest numbered test liquid, (Rating No. 1) one drop (approximately 5 mm in diameter or 0.05 mL volume) was placed on each of three locations at least 5 mm apart. The drops were observed for 30 seconds. If, at the end of this period, two of the three dogs were still spherical to hemispherical in shape with no wicking around the drops, three drops of the next numbered liquid were placed on adjacent sites and similarly observed for 30 seconds. The procedure was continued until one of the tesst liquids resulted in two of the three drops failing to remina spherical to hemispherical, or wetting or wicking occurred.

The oil repellency rating of a tested fabric is the highest numbered test liquid for which two of three drops remained spherical to hemispherical with no wicking for 30 seconds. In general, treated textiles with a rating of 5 or greater are good or excellent; textiles having a rating of one or greater can be used for certain applications. The following test liquids were employed:

| Oil Repellency Rating | Test Solution | Surface Tension dynes/cm at 25° |
|---|---|---|
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |

-continued

| Oil Repellency Rating | Test Solution | Surface Tension dynes/cm at 25° |
|---|---|---|
| 3 | n-Hexadecane | 27.3 |
| 2 | 65/35 Hexadecane-"Nujol" | 29.6 |
| 1 | "Nujol" (purified petroleum oil) | 31.2 |

Note: Nujol is a trademark of Plough, Inc., for a mineral oil having a Saybolt viscosity of 360/390 at 38° and a specific gravity of 0.880/0.900 at 15° C.

2. Water Repellency

Water repellency of treated fabrics was similarly determined by carefully placing a drop of seven aqueous test solutions on each of three locations at least two inches apart. The test solution used in water repellency testing were as follows:

| Water Repellency Rating | Test Solution |
|---|---|
| 7 | 100% isopropanol |
| 6 | 50/50 isopropanol-water |
| 5 | 30/70 isopropanol-water |
| 4 | 20/80 isopropanol-water |
| 3 | 10/90 isopropanol-water |
| 2 | 5/95 isopropanol-water |
| 1 | 2/98 isopropanol-water |

The water repellency rating corresponded to the highest numbered test solution for which two or the three drops remained spherical or hemispherical and did not wick into the fabric for at least two minutes. The higher the water repellency rating, the better the resistance to staining by water-based substances. Using this test method, treated fabrics with a rating of five or greater are excellent; three or four are good; and anything with a rating or one or greater can be used for certain purposes.

3. Water Repellency (Spray)

Spray water repellency was determined for treated fabric samples using standard Test Method No. 22 of the Americal Association of Textile Chemists and Colorists. In this test, 250 mL of water at 27° C. is poured in a narrow stream onto a fabric sample stretched on a 6-inch (15.2 cm) diameter metal hoop. The water is discharged from a funnel suspended six inches (15.2 cm) above the fabric sample. After removal of excess water, the fabric is visually scored by reference to published standards. A rating of 100 denotes no water penetration or surface adhesion; a rating of 90 denotes slight random sticking or wetting; lower values indicate greater wetting. In the following tables, results of repellency testing of various composition/propellant formulations of different fabric samples are reported. Each formulation contained two fluoropolymers. The first fluoropolymer, present at 0.6% by weight, corresponded to class "A", above, and was prepared as just described. The second fluoropolymer, corresponding to class "B" above, was present at 0.3% by weight. This material was prepared substantially as described above, but consisted of 69% polymer units derived from perfluoroalkyl methacrylate monomer, 30% polymer units derived from 2-ethylhexyl methacrylate, 0.1% polymer units derived from N-methylol methacrylamide and 0.1% polymer units derived from hydroxyethyl methacrylate. In addition to fluoropolymers, the compositions contained 1.5% PGME and trichlorotrifluoroethane to make 100%. The various formulations are described in Table 1, below:

TABLE 1

| Formulation | Propellant | Wt % Protectant/ Wt % Propellant |
|---|---|---|
| | Composition of Spray Formulations | |
| A | Dichlorofluoromethane | 80/20 |
| B | Mixed propane/isobutane | 80/20 |
| C | Mixed propane/isobutane | 73/27 |
| D | Dichlorodifluoromethane | 70/30 |
| E | 1,1,1-trichlorodifluoroethane | 60/40 |
| F | 1,1-difluoroethane | 80/20 |
| G | Dimethyl ether | 80/20 |
| H | Carbon dioxide (pressurized to 90 psi) | 100 |
| I | Dichlorofluoromethane | 85/15 |
| J | 1,1-difluoroethane | 73/27 |
| K | Dimethyl ether | 73/27 |

Tables 2–7, below, indicate the results of oil, water, and water-spray repellency testing on various fabric types.

TABLE 2

| | Repellency Ratings | | | | | |
|---|---|---|---|---|---|---|
| | Formulation A | | | Formulation B | | |
| Fabric type | Oil | Water | Spray | Oil | Water | Spray |
| nylon | 4 | 6 | 100 | 4 | 5 | 90 |
| nylon | 4 | 6 | 100 | 3 | 6 | 90 |
| polyester/cotton | 4 | 4 | 70 | 5 | 4 | 70 |
| polyester/cotton | 4 | 4 | 70 | 4 | 4 | 70 |
| nylon face/rayon back | 5 | 5 | 50 | 5 | 4 | 50 |
| polyester | 6 | 8 | 70 | 5 | 7 | 70 |
| nylon/polyester/rayon | 5 | 6 | 70 | 5 | 7 | 70 |
| polypropylene/polyester | 2 | 4 | 50 | 3 | 4 | 50 |
| polyester | 3 | 6 | 0 | 4 | 6 | 0 |
| polyester | 1 | 4 | 0 | 1 | 4 | 0 |

TABLE 3

| | Repellency Ratings | | | | | |
|---|---|---|---|---|---|---|
| | Formulation C | | | Formulation D | | |
| Fabric type | Oil | Water | Spray | Oil | Water | Spray |
| nylon | 4 | 6 | 90 | 4 | 6 | 90 |
| nylon | 4 | 6 | 90 | 4 | 6 | 90 |
| polyester/cotton | 5 | 4 | 70 | 4 | 4 | 70 |
| polyester/cotton | 3 | 4 | 70 | 3 | 4 | 70 |
| nylon face/rayon back | 4 | 5 | 50 | 4 | 5 | 70 |
| polyester | 5 | 8 | 70 | 5 | 7 | 70 |
| nylon/polyester/rayon | 5 | 7 | 70 | 4 | 6 | 70 |
| polypropylene/polyester | 3 | 4 | 50 | 2 | 3 | 50 |
| polyester | 2 | 5 | 0 | 3 | 6 | 0 |
| polyester | 1 | 5 | 0 | 1 | 4 | 0 |

TABLE 4

| | Repellency Ratings | | | | | |
|---|---|---|---|---|---|---|
| | Formulation E | | | Formulation F | | |
| Fabric type | Oil | Water | Spray | Oil | Water | Spray |
| nylon | 2 | 4 | 80 | 2 | 4 | 90 |
| nylon | 2 | 4 | 80 | 2 | 4 | 90 |
| polyester/cotton | 1 | 3 | 50 | 4 | 4 | 70 |
| polyester/cotton | 1 | 3 | 50 | 4 | 4 | 70 |
| nylon face/rayon back | 0 | 3 | 50 | 5 | 5 | 50 |
| polyester | 4 | 5 | 70 | 5 | 5 | 70 |
| nylon/polyester/ | 2 | 4 | 70 | 5 | 6 | 70 |
| polypropylene/polyester | 0 | 2 | 50 | 2 | 3 | 50 |

TABLE 4-continued

| Fabric type | Repellency Ratings Formulation E Oil | Water | Spray | Formulation F Oil | Water | Spray |
|---|---|---|---|---|---|---|
| polyester | 0 | 3 | 0 | 4 | 6 | 70 |
| polyester | 0 | 0 | 0 | 0 | 3 | 0 |

TABLE 5

| Fabric type | Repellency Ratings Formulation G Oil | Water | Spray | Formulation H Oil | Water | Spray |
|---|---|---|---|---|---|---|
| nylon | 3 | 5 | 90 | 4 | 6 | 100 |
| nylon | 2 | 4 | 90 | 4 | 6 | 90 |
| polyester/cotton | 2 | 2 | 50 | 5 | 4 | 70 |
| polyester/cotton | 0 | 2 | 0 | 5 | 4 | 50 |
| nylon face/rayon back | 2 | 4 | 50 | 3 | 4 | 50 |
| polyester | 4 | 5 | 70 | 6 | 6 | 70 |
| nylon/polyester/rayon | 2 | 5 | 70 | 4 | 5 | 70 |
| polypropylene/polyester | 0 | 2 | 0 | 2 | 4 | 50 |
| polyester | 1 | 4 | 70 | 3 | 5 | 70 |
| polyester | 0 | 4 | 0 | 0 | 3 | 50 |

TABLE

| Fabric type | Repellency Ratings Formulation K Oil | Water | Spray |
|---|---|---|---|
| nylon | 4 | 6 | 90 |
| nylon | 3 | 6 | 90 |
| polyester/cotton | 5 | 4 | 70 |
| polyester/cotton | 3 | 3 | 70 |
| nylon face/rayon back | 4 | 4 | 50 |
| polyester | 5 | 5 | 70 |
| nylon/polyester/rayon | 4 | 5 | 70 |
| polypropylene/polyester | 2 | 3 | 50 |
| polyester | 2 | 5 | 50 |
| polyester | 0 | 4 | 0 |

TABLE 6

| Fabric type | Repellency Ratings Formulation I Oil | Water | Spray | Formulation J Oil | Water | Spray |
|---|---|---|---|---|---|---|
| nylon | 5 | 6 | 100 | 4 | 6 | 90 |
| nylon | 4 | 6 | 100 | 3 | 6 | 90 |
| polyester/cotton | 5 | 3 | 50 | 2 | 3 | 50 |
| polyester/cotton | 5 | 4 | 70 | 2 | 3 | 50 |
| nylon face/rayon back | 5 | 4 | 70 | 4 | 6 | 50 |
| polyester | 5 | 6 | 70 | 6 | 6 | 70 |
| nylon/polyester/rayon | 4 | 6 | 70 | 3 | 6 | 70 |
| polypropylene/polyester | 2 | 4 | 50 | 3 | 4 | 50 |
| polyester | 3 | 5 | 50 | 3 | 5 | 70 |
| polyester | 0 | 4 | 0 | 0 | 4 | 0 |

What is claimed is:

1. A organic solvent-based fabric treatment composition for imparting oil- and water-repellency to textiles, comprising by weight:

(a) 0.1-5%-fluoropolymer comprising (1) 40-90% polymer chain units derived from a perfluor-oalkyl (meth)acrylate monomer. formula $CF_3CF_2(CF_2)_kC_2H_4OC(O)CR=CH_2$, where R is —H or —$CH_3$ and k is an even integer from 2 to 12; and (2) 10-60% polymer chain units derived from 2-chlorohydroxypropyl methacrylate; or (3) 10-60% polymer chain units derived from an alkyl (meth)acrylate having an alkyl chain length of 2-18 carbons; and (4) up to 1% polymer chain units derived from N-methylol (meth)acrylamide or hydroxyethyl (meth) acrylate or both; and (b) 0.1-10% propylene glycol. monomethyl ether; in a organic solvent base consisting essentially of at least 80% by weight trichlorotrifluoroethane.

2. A composition according to claim 1, consisting essentially of:

(a) 0.1-5% mixed fluoropolymer comprising:

(1) 60-80%, by weight of fluoropolymer, of a first fluoropolymer component consisting essentially of:

(i) 40-90% polymer chain units derived from a perfluoroalkyl (meth)acrylate monomer of formula $CF_3CF(CF_2)_kC_2H_4OC(O)CR=CH_2$, where R is —H or —$CH_3$ and k is an even integer from 2 to 12; and (ii) 10-60% polymer chain units derived from 2-chlorohydroxypropyl methacrylate; and (2) 20-40%, by weight of fluoropolymer, of a second fluoropolymer component consisting essentially of:

(i) 40-90% polymer chain units derived from a perfluoroalkyl (meth)acrylate monomer of formula $CF_3CF_2(CF_2)_kC_2H_4OC(O)CR=CH_2$, where R is —H or —$CH_3$ and k is an even integer from 2 to 12; and (ii) 10-60% polymer chain units derived from an alkyl (meth)acrylate having an alkyl chain length of 2-18 carbons; and (iii) up to 1% polymer chain units derived from N-methylol (meth)acrylamide or hydroxyethyl (meth)acrylate or both; and (b) 0.1-10% propylene glycol monomethyl ether; in a solvent base consisting essentially of at least 80% by weight trichlorotrifluoroethane.

3. A composition according to claim 2, consisting essentially of:

(a) 0.1-5% mixed fluoropolymer comprising:

(1) 65-75%, by weight of fluoropolymer, of a first fluoropolymer component consisting essentially of:

(i) 60-80% polymer chain units derived from a perfluoroalkyl (meth)acrylate monomer of formula $CH_3CF_2(CF_2)_kC_2H_4OC(O)CR=CH_2$, where R is —H or —$CH_3$ and k is an even integer from 2 to 12; and (ii) 20-40% polymer chain units derived from 2-chlorohydroxypropyl methacrylate; and (2) 20-40%, by weight of fluoropolymer, of a second fluoropolymer component consisting essentially of:

(i) 60-80% polymer chain units derived from a perfluoroalkyl (meth)acrylate monomer of formula $CF_3CF_2(CF_2)_kC_2H_4OC(0)CR=CH_2$, where R is —H or —$CH_3$ and k is an even integer from 2 to 12; and 20-40% polymer chain units derived from an alkyl (meth)acrylate having an alkyl chain length of 2-18 carbons; and (iii) up to 1% polymer chain units derived from N-methylol (meth)acrylamide or hydroxyethyl (meth)acrylate or both; and (b) 0.1–10% propylene glycol monomethyl ether; in a solvent base consisting essentially of at least 80% by weight trichlorotrifluoroethane.

4. A composition according to claim 3, consisting essentially of:

(a) 0.1–5% mixed fluoropolymer comprising:

(1) 65–75%, by weight of fluoropolymer, of a first fluoropolymer component consisting essentially of:

(i) 70–80% polymer chain units derived from a perfluoroalkyl (meth)acrylate monomer of formula $CF_3CF_2(CF_2)_kC_2H_4OC(0)CR=CH_2$, where R is —H or —$CH_3$ and k is an even integer from 2 to 12; and (ii) 20–30% polymer chain units derived from 2-chlorohydroxypropyl methacrylate; and (2) 20–40%, by weight of fluoropolymer, of a second fluoropolymer component consisting essentially of:

(i) 65–75% polymer chain units derived from a perfluoroalkyl (meth)acrylate monomer of formula $CF_3CF_2(CF_2)_kC_2H_4OC(0)CR=CH_2$, where R is —H or —$CH_3$ and k is an even integer from 2 to 12; and (ii) 25–35% polymer chain units derived from an alkyl (meth)acrylate having an alkyl chain length of 2–18 carbons; and (iii) 0.05–1% polymer chain units derived from N-methylol (meth)acrlam or hydroxyethyl (meth)acrylate or both; and (b) 0.1–10% propylene glycol monomethyl ether; in a solvent base consisting essentially of at least 80% by weight trichlorotrifluoroethane.

5. A composition according to claim 1, wherein the alkyl (meth)acrylate is selected from the group consisting of 2-ethylhexyl (meth)acrylate, octyl (meth)acrylate, isodecyl (meth)acrylate, lauryl (meth)acrylate, and stearyl (meth)acrylate.

6. A composition according to claim 2, wherein the alkyl (meth)acrylate is selected from the group consisting of 2-ethylhexyl (meth)acrylate, octyl (meth)acrylate, isodecyl (meth)acrylate, lauryl (meth)acrylate, and stearyl (meth)acrylate.

7. A composition according to claim 6, wherein the alkyl (meth)acrylate is 2-ethylhexyl methacrylate.

8. An aerosol spray formulation comprising a composition according to claim 1 in admixture with a suitable propellant.

9. An aerosol spray formulation comprising a composition according to claim 1 in admixture with a propellant selected from the group consisting of dichlorofluoromethane, carbon dioxide, mixtures of propane and isobutane, dichlorodifluoromethane, 1,1,1-chlorodifluoroethane, and 1,1-difluoroethane.

10. An aerosol spray formulation comprising a composition according to claim 2 in admixture with a propellant selected from the group consisting of dichlorofluoromethane, carbon dioxide, mixtures of propane and isobutane, dichlorodifluoromethane, 1,1,1-chlorodifluoroethane, and 1,1-difluoroethane.

11. An aerosol spray formulation comprising a composition according to claim 3 in admixture with a propellant selected from the group consisting of dichlorofluoromethane, carbon dioxide, mixtures of propane and isobutane, dichlorodifluoromethane, 1,1,1-chlorodifluoroethane, and 1,1-difluoroethane.

12. An aerosol spray formulation comprising a composition according to claim 4 in admixture with a propellant selected from the group consisting of dichlorofluoromethane, carbon dioxide, mixtures of propane and isobutane, dichlorodifluoromethane, 1,1,1-chlorodifluoroethane, and 1,1-difluoroethane.

13. An aerosol spray formulation comprising from 70–85% by weight of a composition according to claim 1, and 15–30% by weight of a propellant selected from the group consisting of dichlorofluoromethane, dichlorodifluoromethane, 1,1,1-chlorodifluoroethane, and 1,1-difluoroethane.

14. An aerosol spray formulation comprising from 70–85% by weight of a composition according to claim 2, and 15–30% by weight of a propellant selected from the group consisting of dichlorofluoromethane, dichlorodifluoromethane, 1,1,1-chlorodifluoroethane, and 1,1-difluoroethane.

15. An aerosol spray formulation comprising from 70–85% by weight of a composition according to claim 3, and 15–30% by weight of a propellant selected from the group consisting of dichlorofluoromethane, dichlorodifluoromethane, 1,1,1-chlorodifluoroethane, and 1,1-difluoroethane.

16. An aerosol spray formulation comprising from 70–85% by weight of a composition according to claim 4, and 15–30% by weight of a propellant selected from the group consisting of dichlorofluoromethane, dichlorodifluoromethane, 1,1,1-chlorodifluoroethane, and 1,1-difluoroethane.

* * * * *